US009011356B2

(12) United States Patent
McClorey

(10) Patent No.: US 9,011,356 B2
(45) Date of Patent: Apr. 21, 2015

(54) MULTIPLE POSITION FOOT MASSAGING DEVICE

(76) Inventor: Paul J. McClorey, Howell, MI (US)

( * ) Notice: Subject to any disclaimer, the term of this patent is extended or adjusted under 35 U.S.C. 154(b) by 1093 days.

(21) Appl. No.: 12/554,159

(22) Filed: Sep. 4, 2009

(65) Prior Publication Data

US 2010/0063429 A1 Mar. 11, 2010

Related U.S. Application Data

(60) Provisional application No. 61/094,478, filed on Sep. 5, 2008.

(51) Int. Cl.
*A61H 15/00* (2006.01)

(52) U.S. Cl.
CPC ..... *A61H 15/00* (2013.01); *A61H 2015/0014* (2013.01); *A61H 2201/169* (2013.01); *A61H 2205/12* (2013.01)

(58) Field of Classification Search
CPC ..... A61H 15/00; A61H 1/0266; A61H 2015/0007; A61H 2015/0014; A61H 2015/0021; A61H 2015/0028; A61H 2015/0035; A61H 2015/0042; A61H 2015/005; A61H 2205/12
USPC ..... 601/23, 27, 112, 118–123, 84, 115, 601/128–129, 131, 134–137; 482/121
See application file for complete search history.

(56) References Cited

U.S. PATENT DOCUMENTS

| | | | | | |
|---|---|---|---|---|---|
| 2,072,959 | A | * | 3/1937 | Mulvaney et al. | 601/122 |
| 2,230,890 | A | * | 2/1941 | McClenathen | 601/122 |
| 2,438,249 | A | | 3/1948 | Mattison | |
| 2,638,089 | A | * | 5/1953 | Murphy | 601/27 |
| 3,088,458 | A | * | 5/1963 | Stewart | 601/122 |
| 3,415,514 | A | * | 12/1968 | Weihs | 482/79 |
| 3,970,078 | A | * | 7/1976 | Rogers, Jr. | 601/125 |
| D242,826 | S | * | 12/1976 | Posh et al. | D24/212 |
| 4,010,743 | A | | 3/1977 | Fitzsimons | |
| 4,047,755 | A | * | 9/1977 | McDonald et al. | 297/216.11 |
| 4,167,940 | A | * | 9/1979 | Ruf | 601/122 |
| 4,629,180 | A | * | 12/1986 | Kaya | 482/140 |
| 4,832,006 | A | * | 5/1989 | Kirsch | 601/122 |
| 5,005,560 | A | * | 4/1991 | Quam et al. | 601/113 |
| 5,433,684 | A | * | 7/1995 | Carrillo | 482/80 |
| 5,603,682 | A | * | 2/1997 | Grider | 482/142 |
| 5,674,185 | A | | 10/1997 | Chang | |
| 6,013,042 | A | | 1/2000 | Sakai | |
| 6,033,372 | A | * | 3/2000 | Tarbet et al. | 601/123 |
| 6,419,650 | B1 | * | 7/2002 | Ryan et al. | 601/122 |
| 6,981,932 | B1 | * | 1/2006 | Huang et al. | 482/72 |
| D527,830 | S | * | 9/2006 | Chien | D24/211 |
| 7,488,277 | B1 | * | 2/2009 | Knapp | 482/104 |
| 2003/0120188 | A1 | * | 6/2003 | Kusumi | 601/115 |
| 2005/0049532 | A1 | * | 3/2005 | Lee | 601/118 |
| 2007/0155594 | A1 | * | 7/2007 | Rogers et al. | 482/94 |

* cited by examiner

*Primary Examiner* — Justine Yu
*Assistant Examiner* — Christopher Miller
(74) *Attorney, Agent, or Firm* — Vincent Re PLLC

(57) ABSTRACT

A foot massaging device having a plurality of parallel cylindrical rollers mounted within a frame. The frame includes adjustment slots allowing the rollers to be relocated within the frame to present various massaging configurations. The foot massaging device is adjustable by seating the rearwardly disposed rollers between a raised and lowered position to configure the rollers to contact different portions of a user's foot.

7 Claims, 3 Drawing Sheets

MULTIPLE POSITION FOOT MASSAGING DEVICE

CROSS-REFERENCE TO RELATED APPLICATIONS

This application claims priority of United States Provisional Patent Application filed Sep. 5, 2008 having Ser. No. 61/094,478.

FIELD OF THE INVENTION

This invention is related to massagers and more particularly to a user manipulated foot massaging device.

BACKGROUND AND SUMMARY OF THE INVENTION

Massage is a well-known technique to increase blood flow and ease muscle tension in a person's body. Typically, in a massage, pressure is applied to a location on the body either by direct hand/finger manipulation or through a device that aids in the application of pressure.

Such devices include both user-manipulated tools and motorized devices which vibrate, knead, and/or rotate to manipulate a desired body part. These massage tools may either be used by the individual receiving the massage or by another person (e.g., a masseuse).

One area of the body that frequently needs the therapeutic effects of massage is the foot, particularly the sole or bottom of the foot. Typical foot massagers have one or more sets of rollers rotatably mounted within a fixed frame. A user rolls his feet across the fixed rollers to apply massaging pressure to the bottom of his foot. These massagers, however, do not allow the user to change the location of the roller(s) in the frame and therefore cannot be configured to optimize the rollers position to target a particular part of the foot.

The broad purpose of the present disclosure is to provide a foot massaging device that has a plurality of foot contacting rollers which can be adjusted to massage various parts of the foot. The massager is adjustable by seating the rearwardly disposed rollers between a raised and lowered position to configure the massager to contact different portions of a user's foot.

The preferred massager includes a frame having opposed vertical walls. Three rollers are adjustably mounted in-parallel between the opposed walls. The rollers are mounted in a spaced relationship such that they present a front, middle and rear roller to a user. The middle and rear rollers being adjustable vertically within channels formed in each wall. In this manner, the middle and rear rollers can be selectively placed in a raised position (relative to the front roller) or in a lowered position where the axis(es) of rotation of the adjustable roller(s) are co-planar with the rotational axis of the front roller.

It is an advantage of the present disclosure that the massaging device allows a user to configure the device to massage a particular part of the foot.

The massager has a first position which aligns all of the rollers in-parallel allowing a user to roll his foot or feet across a substantially horizontal row of spaced massaging rollers. The second position sets the middle roller in the elevated position, while the rear roller is lowered. The second position allows the user to roll his foot along a curved profile to better follow the curvature of the foot's arch. A third position is possible by setting the rear roller in the elevated position, while the middle roller is lowered. In this third position, the front two rollers contact a user's foot bottom, while the rear roller contacts the top of the foot. A fourth position has both the middle and rear rollers in the elevated position, in this fourth position, the massager presents a substantially flat row of rollers that are at an angle relative to the ground (from front to back roller), in this fourth position a user can roll his feet across the rollers while sitting down in substantially the same way as the first position.

It is another advantage of the present disclosure that the rollers can be supplemented with a textured outer surface to further increase and vary the pressure exhibited on the user's feet when rolled across the device.

It is still another advantage of the present disclosure that each of the rollers is comprised of two axially aligned rollers which are independently rotatable about a common axis of rotation. In this manner, a user can roll both feet simultaneously across the rollers at different speeds and/or in opposite directions.

Still further objects and advantages of this disclosure will become readily apparent to those skilled in the art to which the invention pertains upon reference to the following detailed description.

BRIEF DESCRIPTION OF THE DRAWINGS

The description refers to the accompanying drawings in which like reference characters refer to like parts throughout the several views and in which.

DETAILED DESCRIPTION OF THE INVENTION

Figure 1:
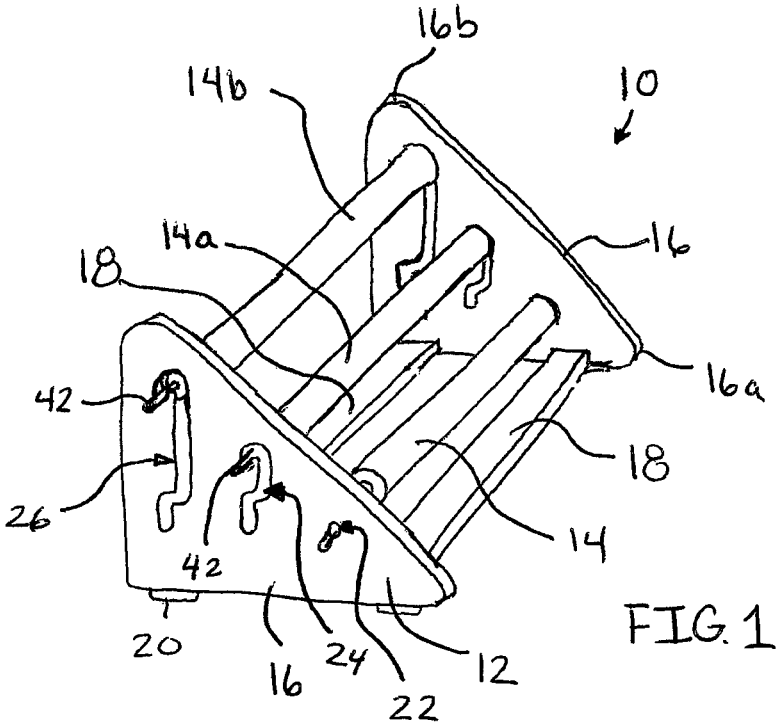
FIG. 1 is a perspective view illustrating a massaging device embodying the invention.

Referring now to FIGS. 1-4, a preferred foot massaging device or massager 10 is illustrated. Massager 10 includes a frame 12 which supports a plurality of rollers, denoted 14, 14*a*, and 14*b* when mounted in frame 12.

Frame 12 includes a pair of opposed vertical walls 16 which are interconnected by support bars 18 adjacent to the bottom ends of the walls. Each wall 16 is generally triangular in shape, angling from a lower-most front end 16*a* to an upper-most rear end 16*b*. Frame 12 is preferably formed from a rigid and durable material, such as metal or plastic. Resilient feet members 20 are mounted to the underside of frame 12.

Figure 3:
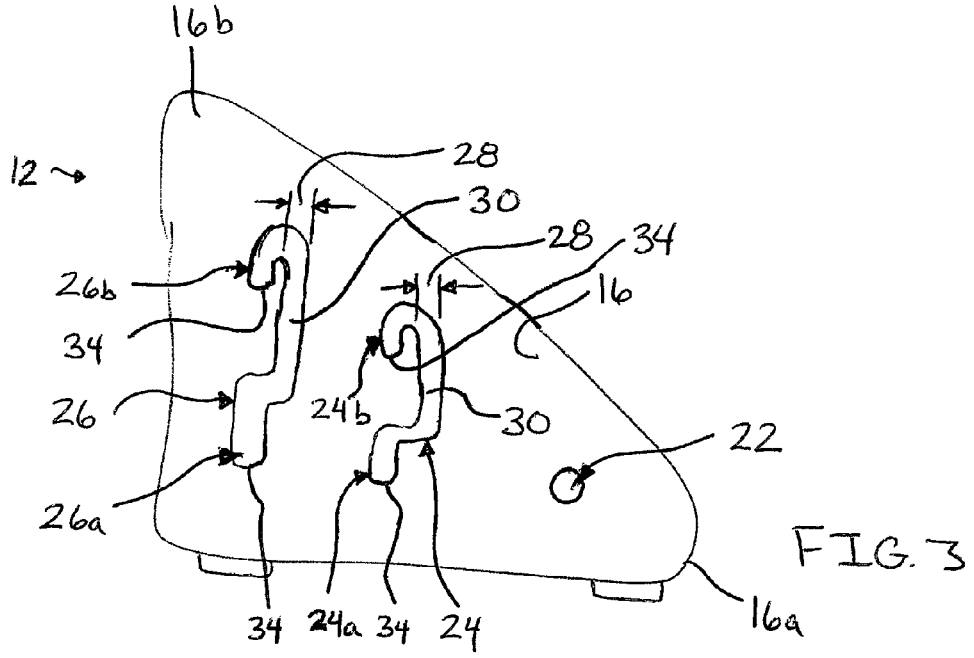
FIG. 3 is a side view of one of the frame walls, illustrating the roller seat channels.

As best shown in FIG. 3, each wall 16 includes three roller mounting apertures passing between the outer and inner surfaces of the wall. Each mounting aperture has at least one roller receiving or bearing surface that is equally spaced apart from the adjacent mounting aperture. In the preferred embodiment, the front aperture 22 has a cylindrical through bore. The other two roller mounting apertures 24 and 26 are formed having two roller bearing surfaces or seats formed by a slot or groove passing through the wall. Each slot 24, 26 has a substantially constant opening width 28 that is equal to the diameter of front aperture 22.

Both mounting slots 24, 26 have the same general "question-mark" shape, with a lower seat 24*a*, 26*a* at the bottom of the slot and an upper seat 24*b*, 26*b* in an upper portion of the slot. The upper seats 24*b*, 26*b* are vertically aligned with their respective lower seat 24*a*, 26*a*. To interconnect the two seats 24*a*, 24*b* and 26*a*, 26*b*, each slot has an elongated vertical portion 30 that is offset from the vertically aligned seats. Each portion 30 is preferably offset away from the seats in the direction of the front aperture 22. As shown, the vertical portion of the rear slot 26 is longer than the vertical portion of middle slot 24 to ensure that the upper seats 24*b* and 26*b* cooperate with front aperture 22 to form a substantially straight line.

The slot seats 24*a*, 24*b* and 26*a*, 26*b* all have a generally semi-circular bottom surface 34. The lower portion of each slot starts at the lower seat 24*a*, 26*a*, then rises vertically a distance that is two to fours times the slot width 28, then turns horizontally to the offset vertical slot portion 30. The upper portion of each slot 24, 26 curves up and away from vertical portion 30 returning back to a generally vertical orientation and then terminating at upper seat 26.

In the preferred embodiment, lower seats 24*a* and 26*a* are horizontally aligned with front aperture 22, while the upper seats 24*b* and 26*b* are also aligned with front aperture 22 at an acute angle to the horizontal. In the preferred embodiment, this angle is in the range of fifteen to sixty degrees. It should be appreciated that each of the respective apertures 22, 24, 26 is aligned with an identical aperture formed in the opposing wall. In this manner, the paired roller bearing surfaces (i.e., apertures 22, seats 24*a* and seats 24*b* in the opposing walls 16) are aligned and are substantially parallel to the ground.

Figure 4:
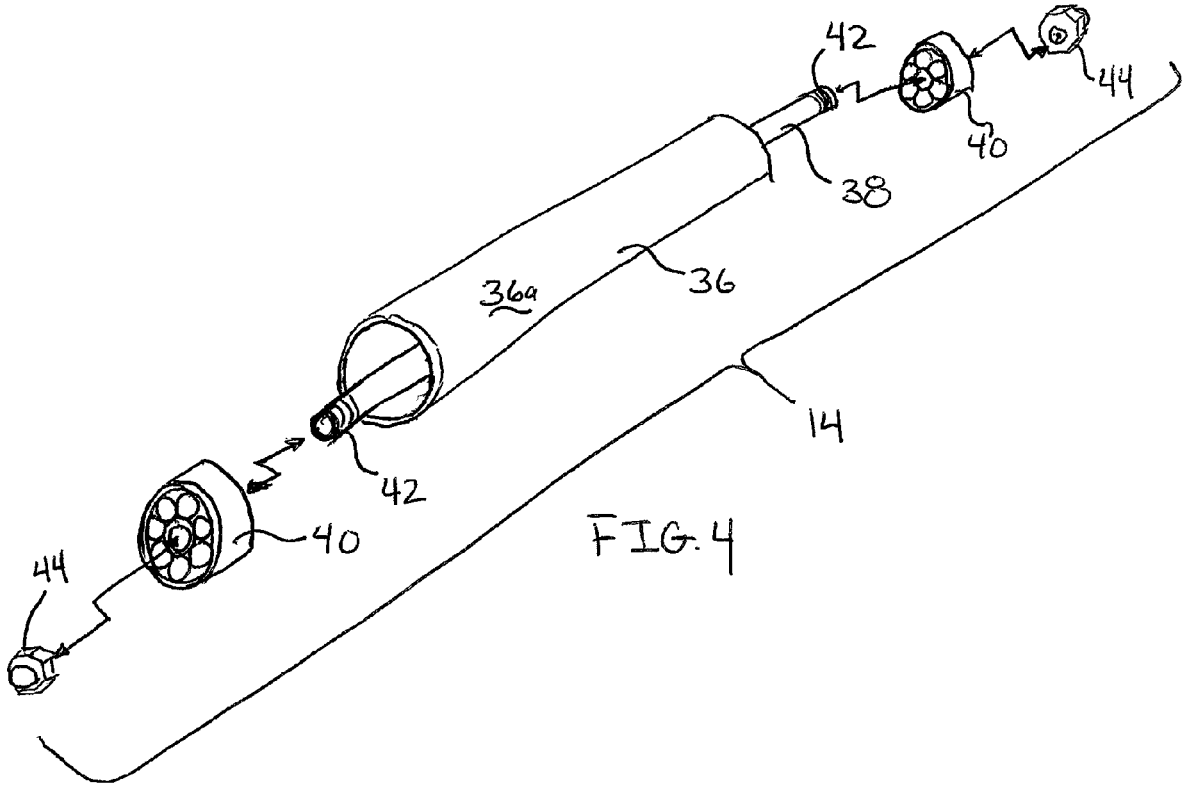
FIG. 4 is perspective, partially exploded view of a roller assembly.

Referring now to FIG. 4, a roller assembly 14 is shown having a tubular body 36 that concentrically receives an elongated axle 38. Body 36 rotates about axle 38 via roller bearings 40 (e.g., ball bearings). The outer surface 36*a* of the body is generally smooth allowing a user's feet to roll over the surface.

Figure 2:
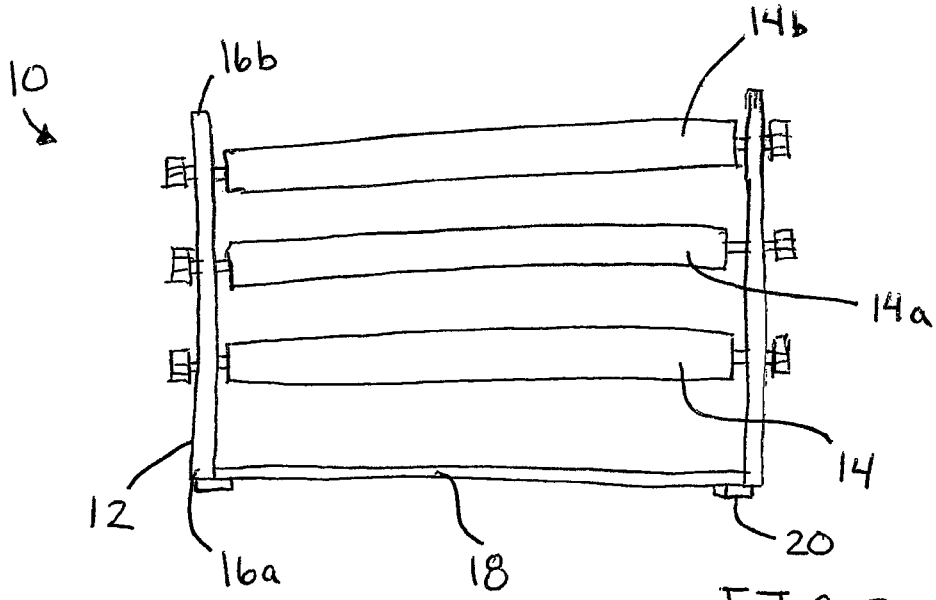
FIG. 2 is a front view of the massaging device.

As shown in FIGS. 1 and 2, the outer ends 42 of the axle passes through the apertures 22, 24, 26 and are held within frame 12 by conventional fasteners 44. Three rollers 14 are mounted between the paired apertures 22, 24 and 26 wherein each roller body 36 is bounded by the opposing walls 16 and are substantially parallel to each other. The front roller 14*a* is mounted within front apertures 22, the middle roller 14*b* is mounted within middle apertures 24, and the rear roller 14*c* is mounted within the rear apertures 26. It should be appreciated that axle 38 is sized to fit within and slide along the circuitous shape of slots 24, 26 and is selectively positioned in either of the lower seats 24*a*, 26*a* or the upper seats 24*b*, 26*b* (as shown in FIGS. 1 and 2).

Referring now to FIGS. 3 and 5-8, the various roller configurations of the massager 10 are illustrated in schematic form depicting each roller's relative position when seated within a particular seat 24*a*, 24*b*, 26*a*, 26*b*.

Figure 5:
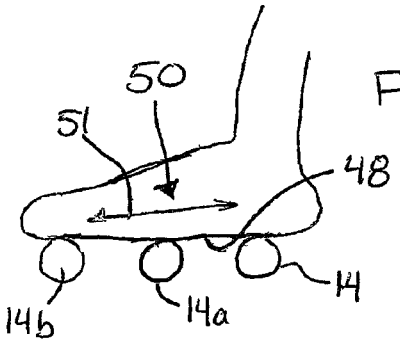
FIG. 5 is a side schematic view showing the massaging device in a first roller configuration.

FIG. 5 shows the middle roller 14*b* and the rear roller 14*c* positioned in the lower seats 24*a* and 26*a*, respectively, to present a substantially flat rolling surface to the bottom 48 of a user's foot 50 allowing the foot (or feet) to follow a substantially flat motion as shown in arrow 51.

Figure 6:
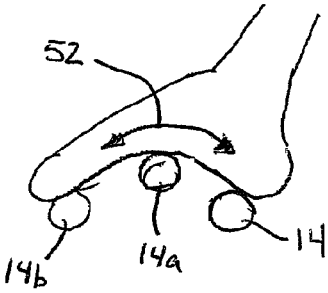
FIG. 6 is a side schematic view showing the massaging device in a second roller configuration.

FIG. 6 shows the middle roller 14*b* positioned in the upper seats 24*b*, while the rear roller 14*c* is in the lower seats 26*a* to present a convex curved surface, which follows the arch shape of a the bottom 48 of the foot as shown in arrow 52.

Figure 7:
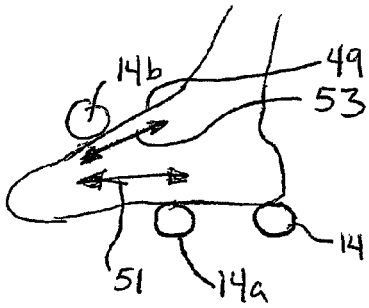
FIG. 7 is a side schematic view showing the massaging device in a third roller configuration.

FIG. 7 shows the middle roller 14*b* positioned in the lower seats 24*a*, while the rear roller 14*c* is in the upper seats 26*b* to allow a user to roll both the top 49 of his foot (along arrow 53) and the bottom 48 of his foot (along arrow 51) against the massager.

Figure 8:
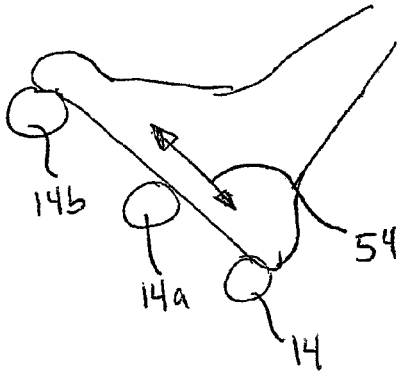
FIG. 8 is a side schematic view showing the massaging device in a fourth roller configuration.

FIG. 8 shows both the middle and rear rollers positioned in the upper seats 24*b*, 26*b* to present a flat angled massaging surface to the user's foot/feet in the directions of arrow 54. It is contemplated that this configuration is best used while the user is seated to reduce leg or knee strain during use.

Figure 9:
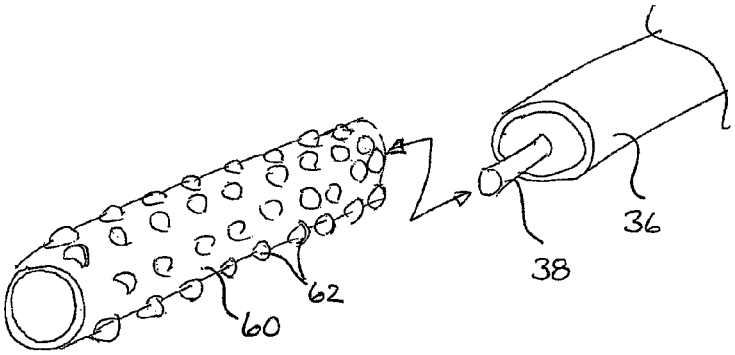
FIG. 9 is a perspective, partially exploded view of a roller sleeve.

Referring now to FIG. 9, massager 10 may optionally include a textured sleeve 60 having an internal bore sized to frictionally slide over the outer surface 36*a* of the roller body 36. Sleeve 60 is preferably formed from a tough, but pliable, material such as silicone or plastic and has a plurality of raised massaging ridges or nodes 62 covering the its outer surface. In other embodiments, the shape, size, and number of the ridges disposed on the outer surface can vary.

Figure 10:
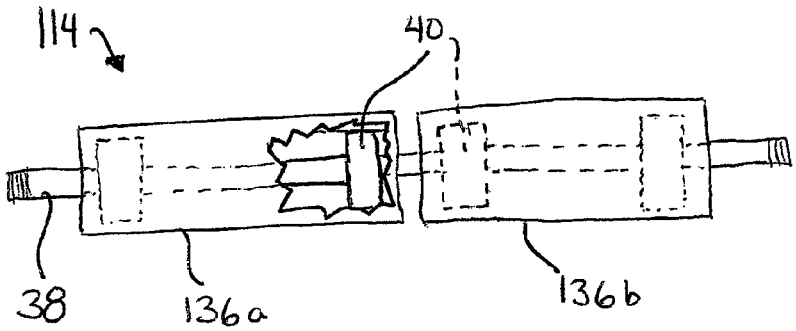
FIG. 10 is a side, partial cut-away view showing an alternate embodiment of the roller assembly.

Referring now to FIG. 10, an alternate embodiment of the rollers is illustrated. In this embodiment, the roller, denoted 114, has separate tubular bodies 136*a*, 136*b* which independently rotate about the axle 38 on their own set of roller bearings 40. In this configuration, a user can roll both feet upon the massager 10 simultaneously in the opposite direction and/or at different speeds.

It should be appreciated that the adjustable slots 24, 26 may include various means to retain their respective rollers within a selected seat. In still other embodiments, the seats may be eliminated or supplemented where the rollers 14 are vertically adjustable along slots in the walls 16 and fixed in a desired location/height by placing the axle 38 in tension through hand-tightening fasteners, e.g., nuts 44, against the walls 16.

From the foregoing description, one skilled in the art will readily recognize that the present disclosure is directed to a foot massager having a plurality of rollers. While the present disclosure has been described with particular reference to various preferred embodiments, one skilled in the art will recognize from the foregoing discussion and accompanying drawing and claims that changes, modifications and variations can be made in the present disclosure without departing from the spirit and scope thereof.

For example and without limitation, while the present disclosure is shown having three roller receiving apertures in each wall, it should be appreciated that any number of apertures and rollers can be used accordingly. Further, while only two seats are disclosed in each adjustment slot, these slots can include any number of seats providing for greater adjustability in roller configuration/angle.

The invention claimed is:

1. A foot massaging device comprising:

a set of three cylindrical rollers each roller being rotatably mounted to and between a pair of opposed support walls, wherein a first roller is configured to spin in a fixed position and wherein a second roller between said first roller and a third roller is configured to spin at a same vertical height as said first roller and comprises a same diameter as said first roller;

a frame having said pair of opposed vertical support walls, said walls each comprising two fully enclosed substantially question mark-shaped slot channels, the second roller being located in one of the slot channels on each wall and the third roller being located in a second of the slot channels on each wall, each slot channel acting as a bearing surface for one of said second roller and said third roller, matching a corresponding one of said slot channels on an opposite of said walls, and configured to adjust a position of said roller located in the slot channel, wherein said slot channels for said third roller each comprise a first seat located at one end of the question mark-shaped slot channels for positioning said third roller in a first lower position and a second seat located at another end of the question mark shape for positioning said third roller in a second higher position and channel travel above the second higher position enabling said third roller to be vertically displaced at least a diameter of said third roller by a user rolling a foot under said third roller;

wherein said second seats enable a roller configuration wherein a top of the foot and a bottom of the foot can be massaged simultaneously; and wherein said channel travel enables said third roller to displace in an upward direction from said second seat.

2. A foot massaging device as defined in claim 1, wherein the second roller is further configured to adjust from the same vertical height as the fixed position of the first roller to a second elevated vertical height between the second higher position for the third roller and the fixed position for the front roller.

3. A foot massaging device as defined in claim 2, wherein the first roller in the fixed position, the second roller at the second elevated vertical height, and the third roller in the second higher position create a plane defined by the three rollers in an acute angle with a horizontal plane, wherein said acute angle is within the range of fifteen to sixty degrees.

4. A foot massaging device comprising:

three rollers, each roller being rotatably mounted to and between a pair of opposed support walls, comprising:

a front roller configured to rotate in a fixed position;

a rear roller configured to adjust between a low position at a same vertical height as the fixed position of the front roller and a high position; and a middle roller comprising a same diameter as the front roller and configured to adjust between a low position at the same vertical height as the fixed position of the front roller and a middle position located at a vertical height between the high position for the rear roller and the fixed position for the front roller; and a frame having the opposed vertical walls, the walls each comprising two matching fully enclosed substantially question mark-shaped slot channels, the middle roller being located in one of the slot channels on each wall and the rear roller being located in a second of the slot channels on each wall, each slot channel acting as a bearing surface for the roller located in the slot channel, configured to permit a position of the roller located in the slot channel to be adjusted, and comprising a first roller seat located at one end of the question mark-shaped slot channels for positioning said roller located in the slot channel in a first lower position and a second roller seat located at another end of the question mark shape for positioning said roller located in the slot channel in a second higher position;

wherein said slot channels acting as the bearing surface for the rear roller further comprise channel travel above the second roller seat enabling said rear roller to be vertically displaced at least a diameter of said rear roller by a user rolling a foot under said rear roller, said channel travel enabling said rear roller to displace in an upward direction from said second roller seat; and wherein said slot channels enable a roller configuration wherein the middle roller is in the first roller seats and the rear roller is in the second roller seats enabling a top of the foot and a bottom of the foot can be massaged simultaneously.

5. A foot massaging device as defined in claim 4, wherein the upper roller seat and the lower roller seat within each respective channel are aligned vertically.

6. A foot massaging device as defined in claim 4, wherein the front roller in the fixed position, the middle roller in the middle position, and the rear roller in the high position create a plane defined by the three rollers in an acute angle with a horizontal plane.

7. A foot massaging device comprising:

three rollers, each roller being rotatably mounted to and between a pair of opposed vertical support walls, comprising:

a front roller configured to rotate in a fixed position;

a rear roller configured to adjust between a low position at a same vertical height as the fixed position of the front roller and a high position; and a middle roller comprising a same diameter as the front roller and configured to adjust between a low position at the same vertical height as the fixed position of the front roller and a middle position located at a vertical height between the high position for the rear roller and the fixed position for the front roller; and a frame having the opposed vertical support walls, said walls each comprising two matching fully enclosed substantially question mark-shaped slot channels, the middle roller being located in one of the slot channels on each wall and the rear roller being located in a second of the slot channels on each wall, each slot channel acting as a bearing surface for the roller located in the slot channel, configured to permit a position of the roller located in the slot channel to be adjusted, and comprising a first seat located at one end of the question mark-shaped slot channels for positioning said roller located in the slot channel in a first lower position and a second seat located at another end of the question mark shape for positioning said roller located in the slot channel in a second higher position;

wherein said slot channels acting as the bearing surface for the rear roller further comprise channel travel above the second roller seat enabling said rear roller to be vertically displaced at least a diameter of said rear roller by a user rolling a foot under said rear roller; and the middle roller and the rear roller being movable to a first configuration which aligns all of the rollers in-parallel allowing the user to roll the foot across a substantially horizontal row of spaced rollers to massage a bottom of the foot;

the middle roller and the rear roller being movable to a second configuration which sets the middle roller in an elevated position, while the rear roller is lowered, in this second configuration rollers allow the user to roll the foot on top of said middle roller to massage the foot bottom along a convex curved profile which mimics a foot's arch;

the middle roller and the rear roller being movable to a third configuration which sets the rear roller in an elevated position, while the middle roller is lowered, in this third configuration the rollers are configured such that the front and middle rollers contact and massage the bottom of the foot of the user, while the rear roller contacts and massages a top of the foot, said channel travel enabling said rear roller to displace in an upward direction from said second roller seat while contacting the top of the foot;

the middle roller and the rear roller being movable to a fourth configuration which has both the middle and rear rollers in an elevated position, in this fourth configuration, the three rollers present a substantially flat row of rollers that are at an acute angle relative to a horizontal plane from the front roller to the back roller, in this fourth configuration, the rollers allow the user to roll the foot across the rollers to massage the bottom of the foot.

* * * * *